United States Patent [19]

Walker

[11] 3,975,018

[45] Aug. 17, 1976

[54] RACKET CONSTRUCTION

[76] Inventor: Frank J. Walker, 8340 NE. Second Ave., Miami, Fla. 33138

[22] Filed: Aug. 8, 1975

[21] Appl. No.: 603,088

[52] U.S. Cl. ..... 273/73 R; 273/186 A

[51] Int. Cl.[2] ..... A63B 49/04

[58] Field of Search ..... 273/26 B, 29 A, 72 R, 273/73 R, 73 C, 73 J, 77 R, 162 R, 186 R, 186 A, 170; 272/57 R

[56] References Cited

UNITED STATES PATENTS

| | | | |
|---|---|---|---|
| 2,780,098 | 2/1957 | Maroth | 273/26 B |
| 3,113,782 | 12/1963 | Guier | 273/186 A |
| 3,136,546 | 6/1964 | Connolly | 273/186 A X |
| 3,172,668 | 3/1965 | Blake | 273/186 A |
| 3,572,706 | 3/1971 | Schroder | 273/186 A X |
| 3,575,419 | 4/1971 | Davis | 273/186 A |
| 3,578,801 | 5/1971 | Piazza | 273/26 B |
| 3,848,873 | 11/1974 | Linning | 273/186 A |
| 3,907,292 | 9/1975 | Moreland | 273/73 C |

FOREIGN PATENTS OR APPLICATIONS

| | | | |
|---|---|---|---|
| 15,733 | 12/1933 | Australia | 273/73 J |

*Primary Examiner*—Richard J. Apley
*Attorney, Agent, or Firm*—Mason, Fenwick & Lawrence

[57] ABSTRACT

A racket is disclosed having a linear guideway extending between the throat and handle portions, a movable weight mounted for movement in the guideway is connected to constant-force springs providing a constant force urging the weight toward the handle, one-way roller clutch means permits extension of the springs during swinging movement of the racket while driving a braking shaft of variable braking cpacity which is manually adjustable by an external knob for effecting variation of the angular velocity of the racket necessary to move the weight to the throat portion to increase the striking force of the racket.

15 Claims, 7 Drawing Figures

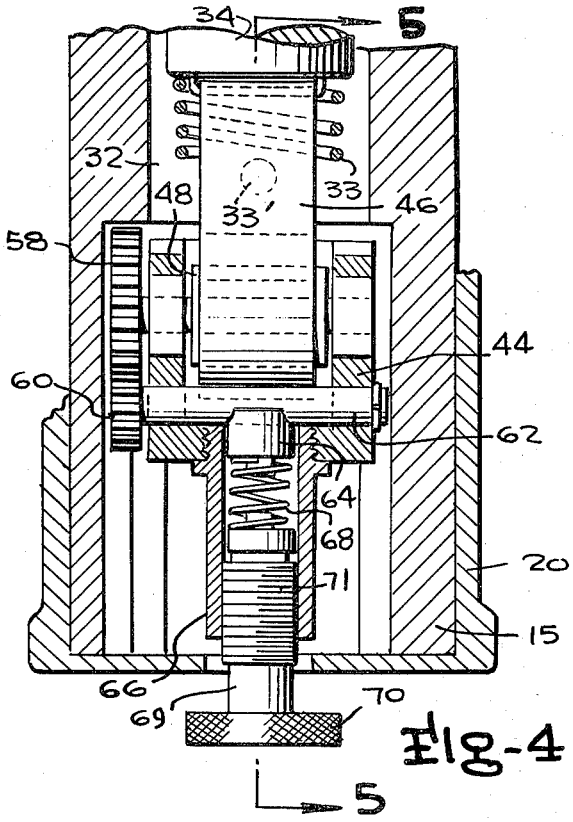
Fig-4
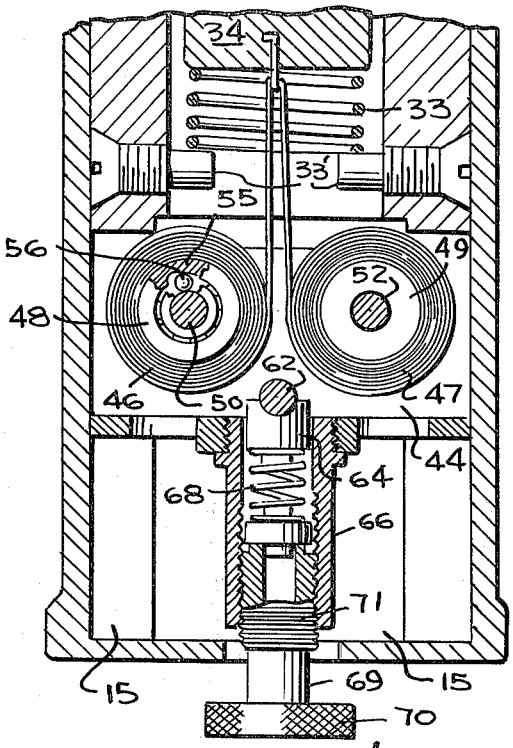
Fig-5
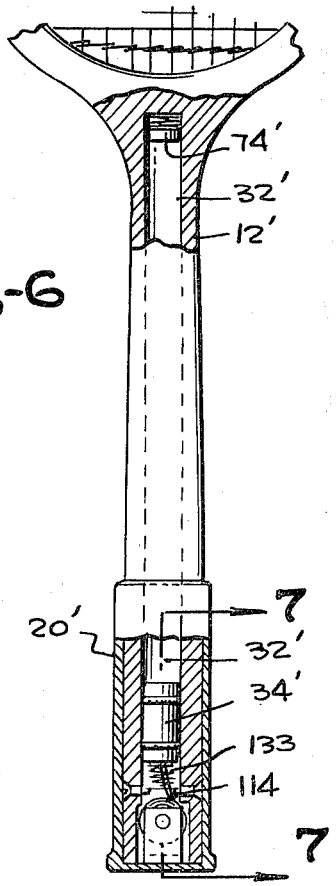
Fig-6
Fig-7
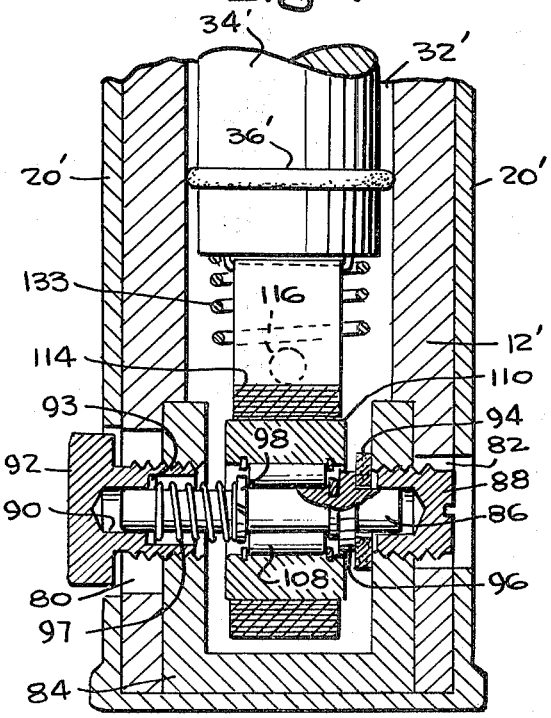

RACKET CONSTRUCTION

This invention is in the field of athletic equipment and is more specifically directed to the field of hand-held devices for striking balls or the like with the preferred embodiment being directed to a tennis or other type racket construction having the ability to strike a ball with greater force than is possible with a conventional racket.

Conventional tennis rackets are inherently based upon design compromises resultant from the fact that a racket should be lightweight in order to be easily maneuvered but should be of sufficient weight to permit striking the ball with substantial force. A heavy racket having its weight concentrated near the string portion is obviously capable of striking the ball with greater force than is a lighter racket; however, a heavy racket is fatiguing to use since more force is required for positioning the racket. Moreover, the increased inertia of a heavy racket increases the time required for repositioning the racket during volleying and consequently impairs the player's ability to make necessary quick positional adjustments of the racket. Obviously, the more close the center of gravity of the racket is to the strings, the greater the inertial resistance to movement of the racket when held in the hand of the user.

As a consequence of the foregoing facts, presently known tennis racket designs are based upon a compromise in which the racket is sufficiently heavy to permit the relatively forceful engagement with the ball but is sufficiently light to permit a fairly quick and unfatiguing positioning of the racket during play. This necessity for design compromise obviously results in a racket not having optimum striking ability or optimum ease of positioning.

While a number of prior art devices such as baseball bats and the like have employed movable weights for shifting the center of gravity of such devices, none of the prior art devices have employed means exerting a constant force on the weight for all positions of travel assumed by the shiftable weight. The closest known prior art patents are U.S. Pat. Nos. 1,113,162; 1,465,056; 1,603,904; 2,051,083; 2,124,534; 2,203,893; 3,116,926; 3,137,504; 3,173,688; 3,392,976; 3,414,260 and 3,578,801.

Therefore, it is the primary object of this invention to provide a new and improved hand-held object striking device.

An even more specific object of the invention is the provision of a new and improved racket construction.

Achievement of the foregoing objects is enabled by the preferred embodiment which is in the form of a tennis racket having a linear guideway extending internally along its length between the throat portion and the handle portion of the racket. A movable weight is provided in the guideway and includes Teflon rings extending about the periphery of the weight for providing sliding engagement with the guideway so that the weight is capable of movement from the handle end of the racket to the throat end of the racket during swinging movement of the racket as occurs in usage of the device.

The movable weight member is normally maintained in the handle portion of the racket by first and second coil spring members mounted on support drums in the handle and having their free ends connected to the weight member. The coil spring members are of the constant force type which exerts a constant force regardless of the degree of extension of the coil spring members as they are unwound from their supporting drum. Centrifugal force exerted by the weight member acts against the spring force and when it exceeds the force of the spring members, the weight moves outwardly from the handle to the throat portion of the racket. Since the spring means exerts a constant force irrespective of the position of the weight, an initial movement of the weight caused by the centrifugal force exceeding the spring force results in travel of the weight the full length of the guideway to the throat portion of the racket.

The spring members are respectively mounted on individual drums with a brake shaft positioned between the axis of rotation of the drums and engaging a gear on the shaft on which one of the drums is mounted by means of a one-way clutch. A variably adjustable brake shoe is positioned for engagement with the brake shaft so as to vary the amount of force necessary before the centrifugal force overcomes the combined resistance of the spring and brake means and permits the weight member to move to the outer end of the racket.

The restraining torque exerted by the adjustable brake shoe can be varied by the user by turning a knurled adjustment knob extending from the end of the racket handle. The centrifugal force of the weight member is conveyed to the spring means, the supporting drum and the one-way clutch to a shaft supporting drum means on which the spring means is mounted. The last-mentioned shaft is connected by the gear means to the brake shaft so that the operation of the brake resists rotation of the drum and movement of the weight outwardly along the length of the racket. Consequently, the centrifugal force of the weight member must be greater than the sum of the contraction force of the spring and the resistance provided by engagement of the brake shoe with the brake shaft. Since the resistive force provided by the brake means can be adjusted, the force and consequent angular velocity of the racket at which the weight moves from the handle to the throat portion of the racket can be easily adjusted in accordance with the needs of the particular player. The weight means is returned to its original handle position by the contraction of the constant-force coil spring which results in rotation of the spring supporting drum; however, rotation of the drum is not conveyed to the brake shaft by virtue of the fact that the only drum connected to the brake shaft is connected by means of a one-way clutch which only provides a driving connection between that drum and its supporting shaft when the drum is being urged by the outwardly moving weight in a direction of rotation opposite that which occurs during retraction of the spring members and the connected weight.

A second embodiment of the invention employs a single constant-force coil spring member mounted on a supporting drum by means of a one-way roller clutch drive member. Rotation of the drum is similarly conveyed to a brake member when the weight is moving outwardly of the racket extending the coil spring member so that the centrifugal force exerted by the weight must overcome the sum of the forces of the spring and the brake means. The brake means in the second embodiment is also manually adjustable by means of an external adjustment knob; however, in the second embodiment, the external knob extends outwardly of the side surface of the handle rather than from the end of the handle as is the case of the preferred embodiment.

FIG. 4 is a sectional view taken along lines 4—4 of FIG. 3;

FIG. 5 is a sectional view taken along lines 5—5 of FIG. 4;

FIG. 6 is a plan view of a second embodiment of the invention; and

FIG. 7 is a sectional view taken along lines 7—7 of FIG. 6.

Figures 1, 2, 3:
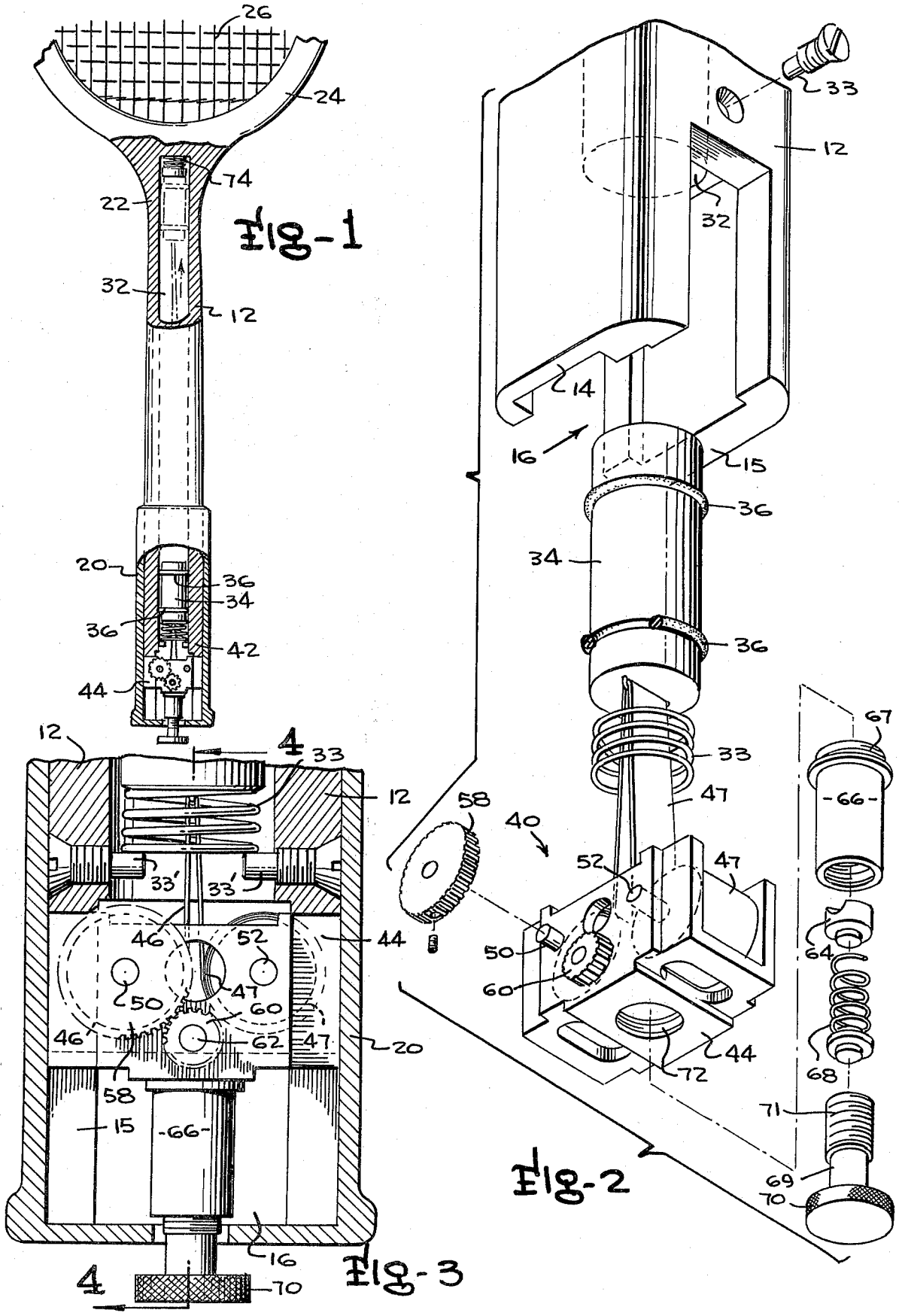
FIG. 1 is an elevational view of a portion of a tennis racket embodying the preferred embodiment of the invention with parts removed for clarity.
FIG. 2 is an exploded perspective view of the operative components of the embodiment of FIG. 1.
FIG. 3 is an enlarged view of the lower end portion of FIG. 1.

Attention is initially invited to FIGS. 1 thru 5 of the drawings which are directed to the preferred embodiment of the invention as employed in a tennis racket having a frame 12 with a bifurcated end consisting of spaced mounting flanges 14 and 15 between which an accurately dimensioned slot 16 is positioned. A handle 20 fits over the bifurcated end of frame 18 with an intermediate throat portion 22 and a head frame portion 24 supporting strings 26 being provided at the opposite end of frame 12 in a well-known manner. In normal use, the racket 13 held by the handle portion and is swung to strike a tennis ball with the strings 26.

The outer end of handle 20 is hollow and is coaxial with a linear guideway 32 extending along the length of the frame 12 from the handle portion to the throat portion 22 as best illustrated in FIG. 1. A weight 34 preferably formed of metal and having a pair of friction-reducing Teflon rings 36 is mounted for movement along the length of the guideway 32 between a first position in handle 20 in which one end abuts against a cushion spring 33 carried by stop members 33' illustrated in solid lines in FIG. 1 and a second position in the throat of the racket illustrated in dotted lines in FIG. 1. The cushion spring 33 could be attached to and travel with weight 34 if desired. The friction-reducing Teflon rings 36 have a very low coefficient of friction with the inner surface of the guideway 32 so that movement of the weight 34 meets very little frictional resistance. It will be apparent that swinging movement of the racket during the normal course of play would tend to move the weight outwardly toward his second position by the action of centrifugal force. However, an adjustable weight control means generally designated 40 and including a component supporting box frame 44 is matingly mounted in slot 16 between mounting flanges 14 and 15 as shown in FIGS. 3, 4 and 5.

First and second constant-force coil springs 46 and 47 are respectively mounted on first and second cylindrical drums 48 and 49 which are in turn respectively supported by shafts 50 and 52 (FIG. 5) carried by box frame 44. It should be noted that the springs 46 and 47 have their free ends connected to weight 34 and tend to maintain the weight 34 in its first position in the handle of the racket as illustrated in FIG. 1. The drum 48 on which spring 46 is mounted is connected to shaft 50 by means of a conventional model DF45877 one-way roller clutch assembly 55 manufactured by The Torrington Company of Torrington, Conn. and which includes rollers 56 engaging shaft 50. Clutch assembly 55 is free running and merely acts as a roller bearing for the drum 48 when the drum rotates in a clockwise direction during retraction of the spring as it moves the weight 34 from the outer end of the racket toward the handle. However, when the weight 34 is moved outwardly toward its second position in the throat portion of the racket, the one-way roller clutch 56 tightly grips the shaft 50 to rotate the shaft and drive a gear 58 on the end of the shaft. Gear 58 meshes with a gear 60 fixedly connected to the outer end of a brake shaft 62.

A variable braking force is applied to the shaft 62 by a brake shoe 64 (FIG. 2) carried on the interior of an internally threaded tubular brake support body 66 and urged against the shaft 62 by a coil compression spring 68. The force provided by the coil compression spring 68 is variably adjusted by adjustment means 69 having a knurled knob 70 and a threaded portion 71 threadably received in the lower or outer end of the tubular brake support body 66. Knurled knob 70 is positioned externally of the racket as shown in FIG. 3. It is to be noted that the upper end of the support body 66 is provided with threads at 67 which are received in a threaded opening 72 on the lower end of the box frame 44. By adjustment of the knob 70, the user can adjust the breakaway force of the weight 34 in accordance with his own individual physical requirements. Such adjustment is possible due to the fact that the coil springs 46 and 47 are constant force springs regardless of the extent to which they are extended outwardly from their normal position. Therefore, it will be seen that adjustment of the knob 70 to apply little or no pressure on the shaft 62 by the brake shoe 64 will permit the weight 34 to move to the outer end of the racket (in second position) when the centrifugal force exerted by the weight 34 exceeds the force exerted by springs 46 and 47. However, by adjusting knob 70 to increase the force of the brake shoe 64 against the shaft 62, the centrifugal force must be increased to exceed the combined force of the springs and the braking force and the racket must consequently be swung at a higher velocity before the weight 34 will move toward its second position.

The employment of the constant-force spring means 46,47 is of substantial importance in that once the centrifugal force overcomes the initial resistance of the spring and brake means, the weight will then move all the way to the outer end of the guideway 32 to its second position in the throat of the racket. As the weight reaches the outer end of the guideway, it is cushioned by a compression spring and a plastic coated bumper assembly 74 illustrated in FIG. 1. A certain degree of air cushioning of the weight is provided by virtue of the fact that only a small clearance is provided between the Teflon rings 36 and the surface of guideway 32 so that the weight 34 and rings 36 act as a dashpot to reduce the velocity of the weight as it nears the throat of the racket; the degree of dashpot effect can be varied by varying the clearance between rings 36 and the surface of guideway 32 so as to vary the air leakage past the rings 36.

By using the constant-force spring means, the weight will always travel the full length of the guideway 32 and its final position is not a function of how fast the racket is swung as would be the case with a conventional spring of the type having progressively increasing force in proportion to its degree of extension. This is of extreme importance since it is the purpose of the invention to position the weight at the outer end of the racket only and not at intermediate positions once the weight departs from its initial position in the handle.

Constant-force springs of the type employed in the invention are commercially available from a number of companies and such springs manufactured by companies such as Ametek, Hunter Spring Division, Hatfield, Pa., and sold under the trademark NEG'ATOR can be employed. Similar springs manufactured by other companies can be used if desired.

By retaining the weight 34 in its first position until the racket is well into its swing, the player can easily adjust the position of the racket without having to overcome the substantial inertial forces that would be required if the weight were positioned further outwardly along the guideway 32. However, when the racket reaches the ball, the weight will have moved to its second position in the throat of the racket to provide additional force in striking the ball. After completion of the racket swing, weight 34 will begin to be retracted toward the handle end of the racket even if the racket is held vertically with the string end down.

A second embodiment of the invention illustrated in FIGS. 6 and 7 is similar to the first embodiment but differs in the employment of only a single constant-force coil spring member as opposed to the dual coil spring members employed in the first embodiment. The second embodiment includes a frame 12' having an axial guideway 32' in which a weight 34' is mounted for movement with a spring biassed cushion disc 74' positioned in the guideway in the throat portion of the racket and a cushion spring 133 and stop means 116 mounted in the guideway at the handle end. A handle 20' is mounted over the end of the frame 12' with transverse apertures 80 and 82 extending outwardly through the sides of the frame 12' and the cover 20'. The cylindrical weight 34' is identical to weight 34 of the first embodiment and includes friction reducing rings 36' identical to the rings 36 employed in the first embodiment.

A weight control means supporting frame 84 is fitted in an opening in the lower end of the racket frame 12' and a transverse drum support shaft 86 is supported by the frame by means of a threaded bearing 88 engaging one end of the shaft and is supported on its opposite end by an internal bearing surface 90 provided in an adjustable knob 92 threadably received in the supporting frame 84 as illustrated in FIG. 7. A friction brake washer 94 is positioned between one side of the frame 84 and a radial brake flange 96 on the drum support shaft 86. Radial flange 96 is urged against friction washer 94 by a coil compression spring 97 encircling the shaft and engaging a radial abutment surface 93 on the knob 92 on one end and a second radial flange 98 on its opposite end so as to bias the shaft 86 to the right as viewed in FIG. 7. Engagement of the brake flange 96 with the brake washer 94 provides a resistance to rotation of the shaft 86 which can be varied in accordance with the rotary position of the knob 92 which varies the compression of spring 97 in an obvious manner so as to vary the braking force applied to the shaft 86.

A one-way clutch including rollers 108 is positioned on shaft 86 between the shaft and a spring mounting drum 110 on which a constant-force spring 114 is coiled. Spring 114 and the one-way clutch are identical in basic construction to the constant-force spring and one-way clutch means employed in the first embodiment.

Spring 114 normally maintains the weight 34' in the position illustrated in FIGS. 6 and 7 in which the end of the weight facing the spring means 114 engages stop members 116. As the racket is swung during play, centrifugal force tends to overcome the constant-force urging of the spring member 114. However, the centrifugal force must overcome the resistance of the spring and the braking means 94 before the weight 34' can move to the opposite end of the guideway 32'. The amount of braking force is easily adjusted by rotation of the knob member 92 in an obvious manner.

While preferred embodiments have been disclosed, it should be understood that many modifications of the disclosed embodiments will undoubtedly occur to those of skill in the art; for example, weight 32 and its associated guideway need not necessarily be of circular cross-section and could be of square or other non-circular section shape if desired. Therefore, the spirit and scope of the invention is of greater breadth than the disclosed embodiments and is to be limited solely by the appended claims.

I claim:

1. An elongated hand-held device for striking another object comprising a handle portion on one end of the device dimensioned to be held in the hand of a user, an object-engaging portion connected to the handle portion for striking an object during use of the device, weight means normally maintained in a first position in said handle portion and release means for permitting movement of said weight means to a second position in the vicinity of said object-engaging portion in response to the angular velocity of the device exceeding a predetermined value as the device is swung by a user, said release means including constant-force providing means for exerting an unchanging constant force on said weight means for all positions of said weight means for urging said weight means toward said handle.

2. The invention of claim 1 wherein said release means includes adjustable brake means for resisting movement of said weight means toward said object engaging portion and said constant-force providing means comprises spring means.

3. The invention of claim 1 wherein said hand-held device comprises a racket and said object-engaging portion comprises string means and a head frame portion supporting said string means and said release means includes adjustable brake means for resisting movement of said weight means toward said string means and further including a linear guideway extending along the length of said handle and with said weight means being positioned in said guideway for movement between said normal position and said second position.

4. The invention of claim 3 wherein said adjustable brake means includes a rotary brake shaft driven by movement of said weight means toward said second position and brake shoe means engaging said brake shaft.

5. The invention of claim 4 wherein said guideway comprises a surface defining a bore having one end in the handle and an opposite closed end adjacent the head frame portion.

6. The invention of claim 5 wherein said movable weight means comprises weight means coaxially positioned in said bore and friction reducing slide means mounted on said weight means and engaging the surface defining said bore.

7. The invention of claim 1 wherein said release means additionally includes drum support shaft means, drum means mounted for rotation on said drum support shaft means, said constant-force providing means comprises spring means normally rolled onto said drum means and connected on a free end to said weight means, one-way clutch means between said drum means and said shaft means for providing driving engagement between said drum means and said shaft means when said spring means is unrolled from said drum means by movement of said weight means away from said drum means along said guideway toward said second position and for permitting rotation of said drum means in an opposite direction which is not conveyed to said shaft means when said spring means is being rolled back onto said drum means during return movement of said weight means to said first position, adjustable braking means operable for providing a desired resistance to rotational movement of said shaft so as to effect obtainment of a desired angular velocity of said racket before said weight moves from said first position all the way to said second position.

8. The invention of claim 7 wherein said drum supporting shaft means comprises first and second shaft members, said constant-force spring means comprises first and second constant-force coil spring members, said drum means comprises first and second drum members on which said first and second constant-force spring members are respectively mounted, said braking means comprises a brake shaft, a brake shoe adjacent said brake shaft, spring means urging said brake shoe against the side of said brake shaft, adjustable knob means for varying the force exerted by said spring means against said brake shoe, gear means providing a driving interconnection between said brake shaft and said first drum supporting shaft and wherein said one-way clutch means is mounted between said first drum supporting shaft and said first drum.

9. The invention of claim 1 wherein said hand-held device comprises a racket having a frame, said object-engaging portion comprises string means on said frame, a linear guideway in said frame extending between the handle portion and a throat portion of the racket frame, said weight means being positioned in said guideway for movement between said first position and said second position, said release means additionally including drum support shaft means, drum means mounted for rotation on said drum support shaft means, said constant-force providing means including ribbon-like spring means normally rolled onto said drum means and connected on a free end to said weight means, one-way clutch means between said drum means and said shaft means for providing driving engagement between said drum means and said shaft means when said spring means is unrolled from said drum means by movement of said weight means away from said drum means along said guideway toward said second position and for permitting rotation of said drum means in an opposite direction which is not conveyed to said shaft means when said spring means is being rolled back onto said drum means during return movement of said weight means to said first position, adjustable braking means operable for providing a desired resistance to rotational movement of said shaft so as to effect obtainment of a desired angular velocity of said racket before said weight moves from said first position toward said second position.

10. The invention of claim 9 wherein said drum supporting shaft means comprises first and second shaft members, said constant-force coil spring means comprises first and second constant-force spring members, said drum means comprises first and second drum members on which said first and second constant-force spring members are respectively mounted, said braking means comprises a brake shaft, a brake shoe adjacent said brake shaft, spring means urging said brake shoe against the side of said shaft, adjustable knob means for varying the force exerted by said spring means against said brake shoe, gear means providing a driving interconnection between said brake shaft and said first drum supporting shaft and wherein said one-way clutch means is mounted between said first drum supporting shaft and said first drum.

11. The invention of claim 9 wherein said braking means includes a brake shaft supporting said drum and friction providing means adjacent said brake shaft, adjustable spring means urging a portion of said brake shaft against said friction providing means, adjustable knob means for varying the force exerted by said spring means to consequently provide variation in the resistance to rotation of said brake shaft and wherein said one-way clutch means is mounted between said brake shaft and said drum.

12. The invention of claim 10 wherein said linear guideway is of circular cross-section, said weight comprises a cylindrical member and additionally including friction reducing ring members mounted on said cylindrical weight.

13. The invention of claim 12 additionally including spring cushion means at the end of said guideway in the throat portion of the racket for providing a cushioned stopping of said weight in said second position.

14. The invention of claim 11 wherein said linear guideway is of circular cross-section, said weight comprises a cylindrical member and friction reducing ring members mounted on said cylindrical weight.

15. The invention of claim 14 additionally including spring cushion means at the end of said guideway in the throat portion of the racket for stopping said weight in said second position.

* * * * *